US010968635B1

(12) United States Patent
Duran

(10) Patent No.: US 10,968,635 B1
(45) Date of Patent: Apr. 6, 2021

(54) ROOF EDGE BLOCKING WITH CLEAT

(71) Applicant: Bernardo Duran, Miami, FL (US)

(72) Inventor: Bernardo Duran, Miami, FL (US)

( * ) Notice: Subject to any disclaimer, the term of this patent is extended or adjusted under 35 U.S.C. 154(b) by 0 days.

(21) Appl. No.: 17/109,314

(22) Filed: Dec. 2, 2020

(51) Int. Cl.
*E04D 3/40* (2006.01)
*E04D 3/363* (2006.01)

(52) U.S. Cl.
CPC ..... *E04D 3/405* (2013.01); *E04D 3/363* (2013.01)

(58) Field of Classification Search
CPC ..... E04D 3/405; E04D 3/363
See application file for complete search history.

(56) References Cited

U.S. PATENT DOCUMENTS 4,780,999 A * 11/1988 Webb ..... E04D 13/155 52/60
6,237,293 B1 5/2001 Gembala
6,421,971 B1 6/2002 Gembala

* cited by examiner

*Primary Examiner* — Patrick J Maestri
(74) *Attorney, Agent, or Firm* — Albert Bordas, P.A.

(57) ABSTRACT

A roof edge blocking with cleat having a blocking assembly with a top flange, a first lateral flange, a second lateral flange, an anchoring flange, and a locking tab; and a cover assembly having a cover top flange, an angular wall, a side flange, and a channel, whereby the cover assembly mounts onto the blocking assembly. The first lateral flange perpendicularly extends from the top flange. An upper wall and a lower wall of the anchoring flange extend perpendicularly from the first and second lateral flanges respectively, and are substantially parallel to the top flange. The upper wall and the lower wall are joined at the anchoring flange to define an elongated aperture. The locking tab extends outwardly from the second lateral flange defining a first predetermined angle. The first lateral flange has a first predetermined height and the second lateral flange has a second predetermined height.

19 Claims, 4 Drawing Sheets

ROOF EDGE BLOCKING WITH CLEAT

BACKGROUND OF THE INVENTION

1. Field of the Invention

The present invention relates to roofing systems, and more particularly, to roof edge blockings with cleats.

2. Description of the Related Art

Applicant believes that one of the closest references corresponds to U.S. Pat. No. 6,237,293 B1 issued to Henry Gembala on May 29, 2001 for Alternative blocking for roof systems. However, it differs from the present invention because Gembala teaches a blocking assembly that include one or more pre-formed component structures fabricated from a non-corrosive, durable material, each of the component structures including an anchoring flange for attachment to the roof structure, an upper flange defining a mounting base for attachment of various roofing components, materials and/or equipment thereto, and an intermediate portion between the anchoring flange and the upper flange creating depth therebetween to accommodate insulation or lightweight concrete.

Applicant believes that another reference corresponds to U.S. Pat. No. 6,421,971 B1 issued to Henry Gembala on Jun. 23, 2002 for Edge closure with cant for roof systems. However, it differs from the present invention because Gembala teaches an integral, pre-formed edge closure fabricated from a non-corrosive, durable material that include an anchoring flange for attachment to a roof structure, an upper flange, an intermediate panel spanning between the anchoring flange and the upper flange, a cant panel positioned at an acute angle relative to the upper flange to define a cant strip along a length of the edge closure, and a mounting strip above the cant panel for securing the edge closure to a concrete parapet or other adjoining vertical wall on a roof structure. The anchoring flange and upper flange are spaced apart for receiving a thickness of insulation of lightweight concrete therebetween. The intermediate panel is provided with vent holes for venting gasses and moisture, which accumulate within the roof structure, thereby reducing the likelihood of premature roof failure.

Other patents describing the closest subject matter provide for a number of more or less complicated features that fail to solve the problem in an efficient and economical way. None of these patents suggest the novel features of the present invention.

SUMMARY OF THE INVENTION

The present invention is a roof edge blocking with cleat comprising a blocking assembly having a top flange, a first lateral flange, a second lateral flange, an anchoring flange, and a locking tab; and a cover assembly having a cover top flange, an angular wall, a side flange, and a channel, whereby the cover assembly mounts onto the blocking assembly.

The first lateral flange perpendicularly extends from the top flange. An upper wall and a lower wall of the anchoring flange extend perpendicularly from the first and second lateral flanges respectively, and are substantially parallel to the top flange. The upper wall and the lower wall are joined at the anchoring flange to define an elongated aperture. The locking tab extends outwardly from the second lateral flange defining a first predetermined angle. The first lateral flange comprises a first predetermined height and the second lateral flange comprises a second predetermined height. The first predetermined height is taller than the second predetermined height. The first lateral flange and the second lateral flange relatively align. The top flange has a first predetermined width and the upper wall has a second predetermined width. The first predetermined width is narrower than the second predetermined width. The blocking assembly further comprises fastening means.

The angular wall extends from the cover top flange to the side flange. The channel is defined by an exterior cleat strip, a base cleat strip, and an interior cleat strip. The base cleat strip is perpendicular to the exterior cleat strip and to the interior cleat strip. The exterior cleat strip extends outwardly from the side flange defining a second predetermined angle. The first predetermined angle defined by the locking tab, and the second predetermined angle defined by the exterior cleat strip, are approximately the same. The interior cleat strip is relatively parallel to the exterior cleat strip, whereby the locking tab is received within the channel defined between the exterior cleat strip and the interior cleat strip.

The blocking assembly is first mounted onto a first roof structure having a first roof edge, whereby the anchoring flange is fixed onto the first roof structure with first fastening means. A second roof structure having a second roof edge is then inserted and mounted onto the upper wall so that the top flange mounts onto a roof top wall, while the first lateral flange and the second lateral flange bias towards an exterior side of a first roof wall and an exterior side of a second roof wall respectively. The cover assembly is then mounted onto the blocking assembly, whereby the channel receives the locking tab, and the side flange is then biased towards the first and second lateral flanges, while the cover top flange mounts onto the top flange and once mounted thereon, the cover assembly is secured to the blocking assembly at the top flange, and to a roof top wall, with second fastening means.

It is therefore one of the main objects of the present invention to provide a roof edge blocking with cleat.

It is another object of this invention to provide a roof edge blocking with cleat, which has a blocking assembly a cover assembly to enhance the roof's perimeter for a better resistance.

It is another object of this invention to provide a roof edge blocking with cleat that can be readily assembled and disassembled without the need of any special tools.

It is another object of this invention to provide a roof edge blocking with cleat, which is of a durable and reliable construction.

It is yet another object of this invention to provide a roof edge blocking with cleat that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
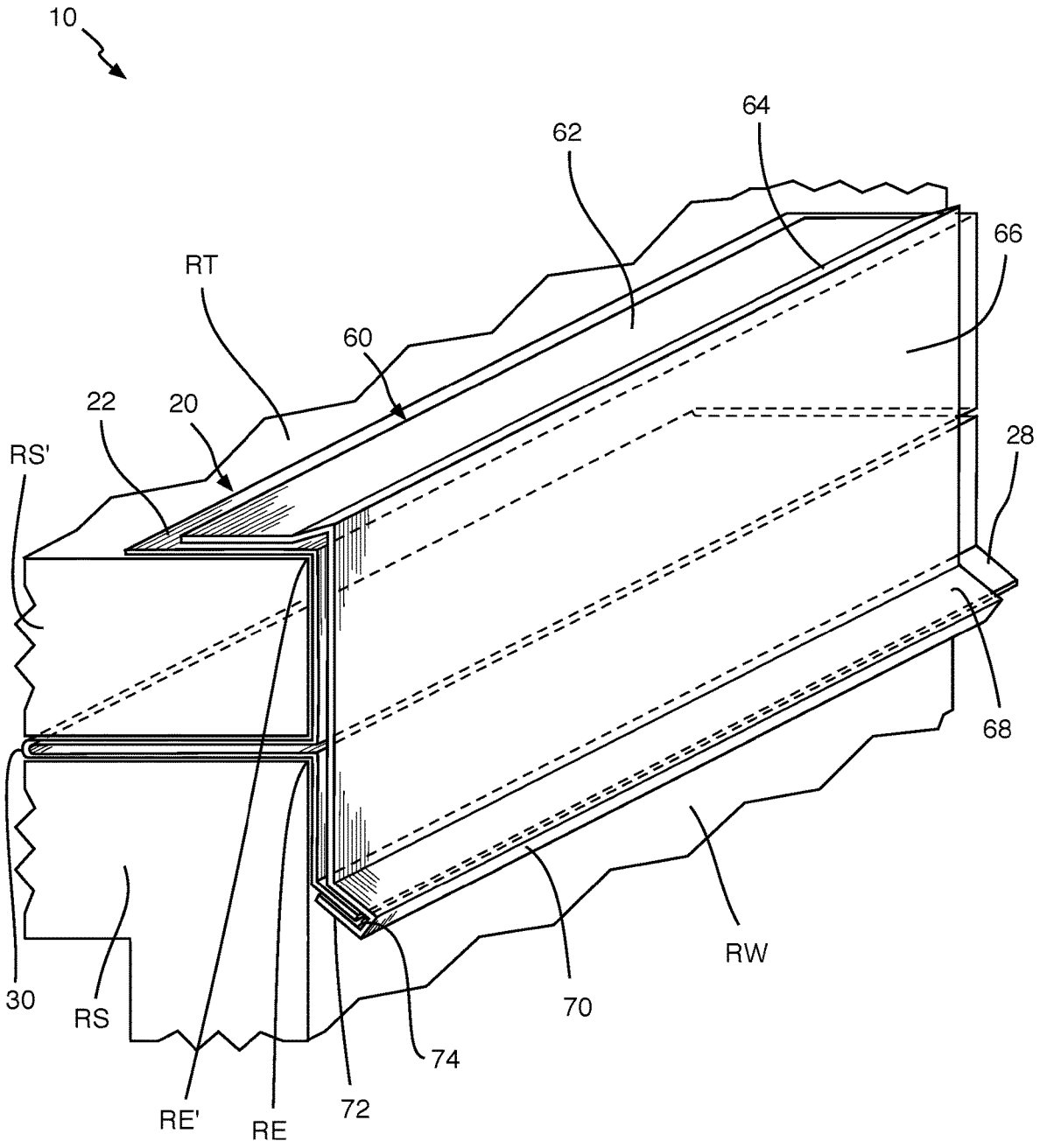
FIG. 1 is an isometric view of the present invention.

Referring now to the drawings, the present invention is a roof edge blocking with cleat, and is generally referred to with numeral 10. It can be observed that it basically includes blocking assembly 20 and cover assembly 60.

As seen in FIG. 1, cover assembly 60 is mounted onto blocking assembly 20. Cover assembly 60 comprises cover top flange 62, angular wall 64, side flange 66, and channel 74. Angular wall 64 extends from cover top flange 62 to side flange 66.

Figure 2:
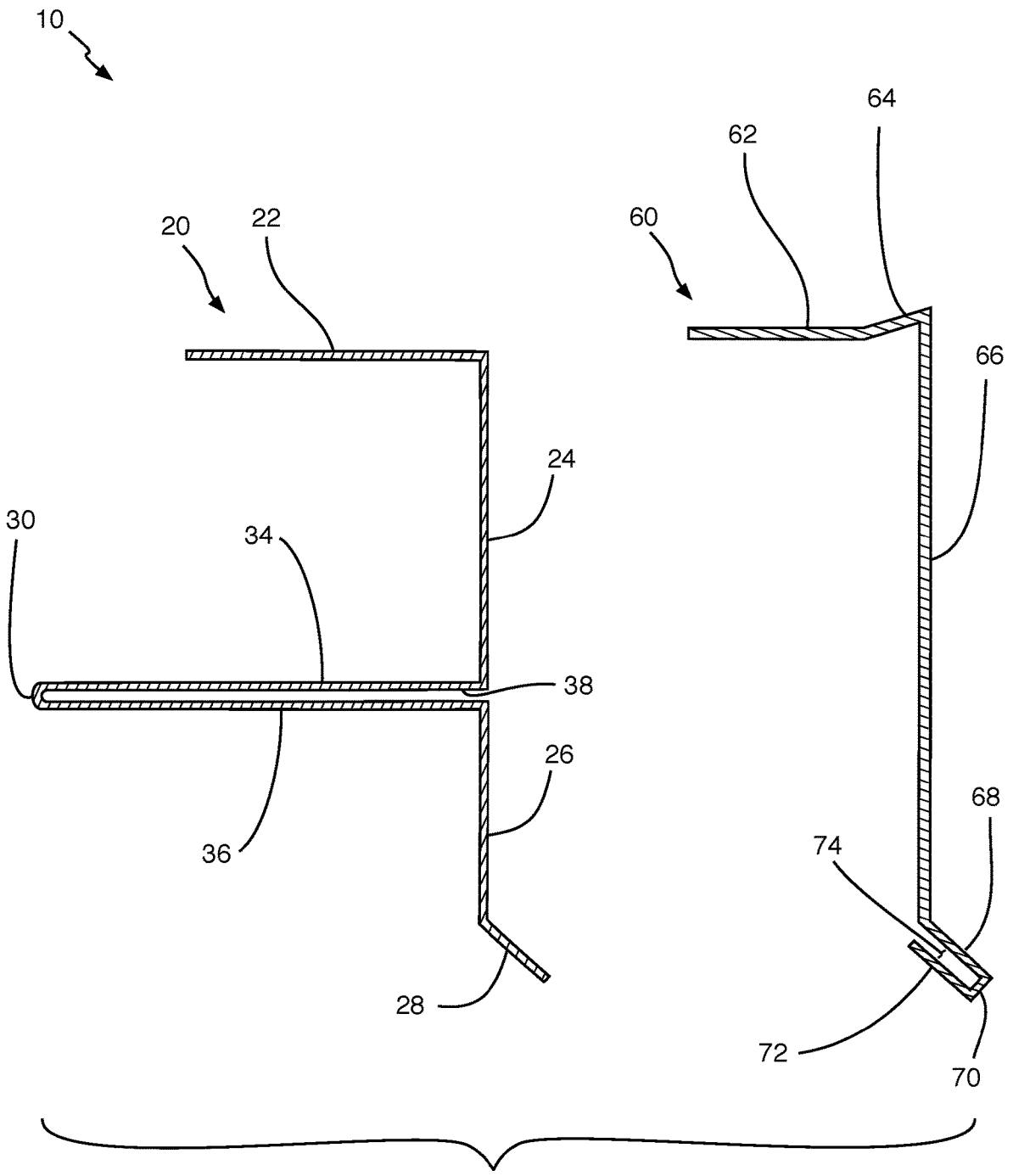
FIG. 2 is an exploded view of the present invention.

As seen in FIG. 2, blocking assembly 20 comprises top flange 22, first lateral flange 24, second lateral flange 26, locking tab 28, and anchoring flange 30. In a preferred embodiment, lateral flange 24 perpendicularly extends from top flange 22. In a preferred embodiment, upper wall 34 and lower wall 36 of anchoring flange 30 extend perpendicularly from first and second lateral flanges 24 and 26 respectively, and are substantially parallel to top flange 22. Upper wall 34 and lower wall 36 are joined at anchoring flange 30 to define elongated aperture 38. Upper wall 34 extends inwardly from lateral flange 24, and lower wall 36 extends inwardly from lateral flange 26. Lateral flange 24 comprises a first predetermined height and lateral flange 26 comprises a second predetermined height. The first predetermined height is taller than the second predetermined height. Lateral flange 24 and lateral flange 26 relatively align. Top flange 22 has a first predetermined width and top wall 34 of anchoring flange 30 has a second predetermined width. The first predetermined width is narrower than the second predetermined width. Locking tab 28 extends outwardly from lateral flange 26 defining a first predetermined angle.

Channel 74 is defined by exterior cleat strip 68, base cleat strip 70, and interior cleat strip 72. Base cleat strip 70 is perpendicular to exterior cleat strip 68 and to interior cleat strip 72. Exterior cleat strip 68 extends outwardly from side flange 66 defining a second predetermined angle. The first predetermined angle defined by locking tab 28, and the second predetermined angle defined by exterior cleat strip 68, are approximately the same. Interior cleat strip 72 is relatively parallel to exterior cleat strip 68, whereby locking tab 28 is received within channel 74 defined between exterior cleat strip 68 and interior cleat strip 72, as better seen in FIG. 1.

Figure 3:
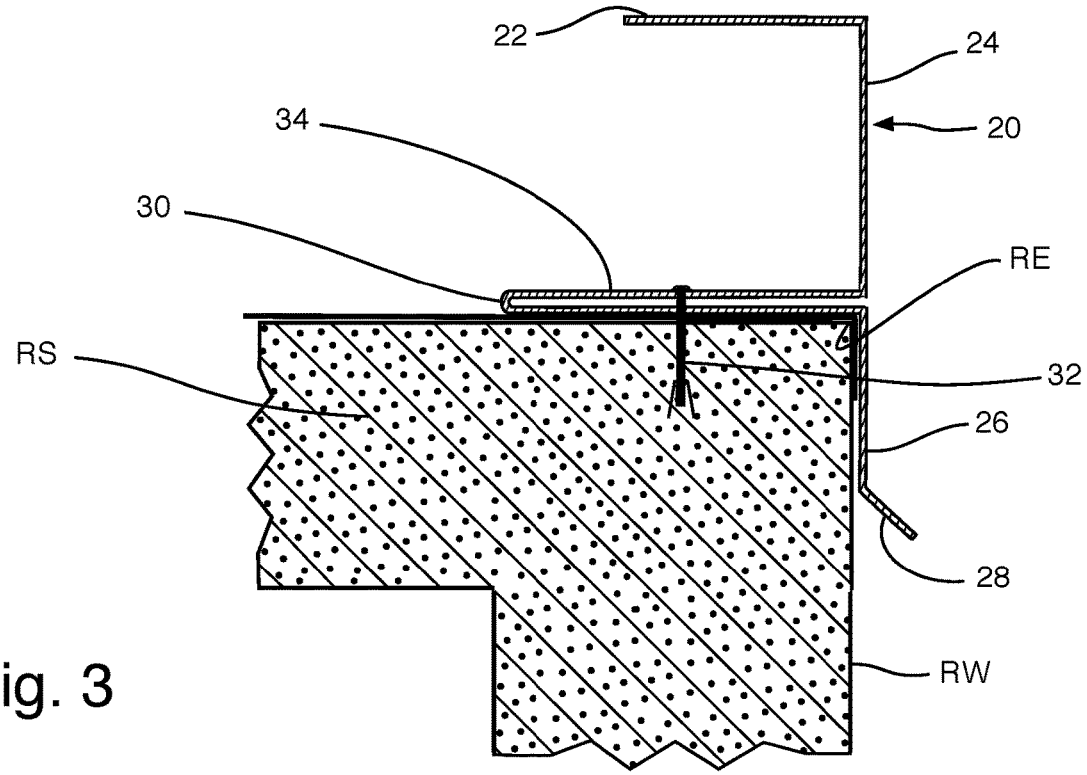
FIG. 3 is a first cross-sectioned side view of the present invention illustrating a first step of securing a blocking assembly onto a roof edge.

As seen in FIG. 3, blocking assembly 20 is first mounted onto roof structure RS having roof edge RE, whereby anchoring flange 30 is fixed onto roof structure RS by fastening means 32.

Figure 4:
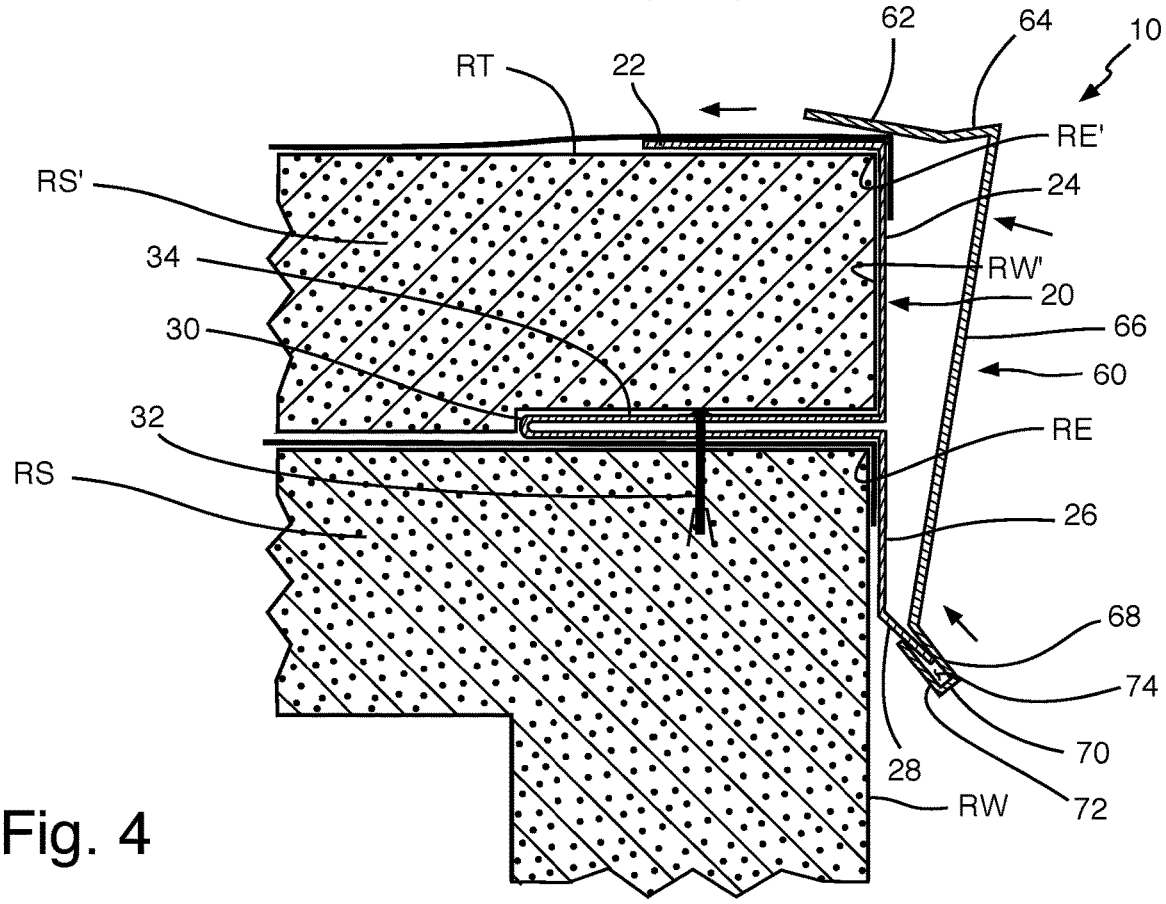
FIG. 4 is a second cross-sectioned side view of the present invention illustrating a second step of securing the blocking assembly onto the roof edge, and a first step of mounting a cover assembly onto the blocking assembly.

As seen in FIG. 4, roof structure RS' having roof edge RE' is then inserted and mounted onto anchoring flange 30 and specifically onto upper wall 34 so that top flange 22 mounts onto roof top wall RT, while first lateral flange 24 and second lateral flange 26 bias towards exterior side of roof wall RW' and exterior side of roof wall RW respectively.

Figure 5:
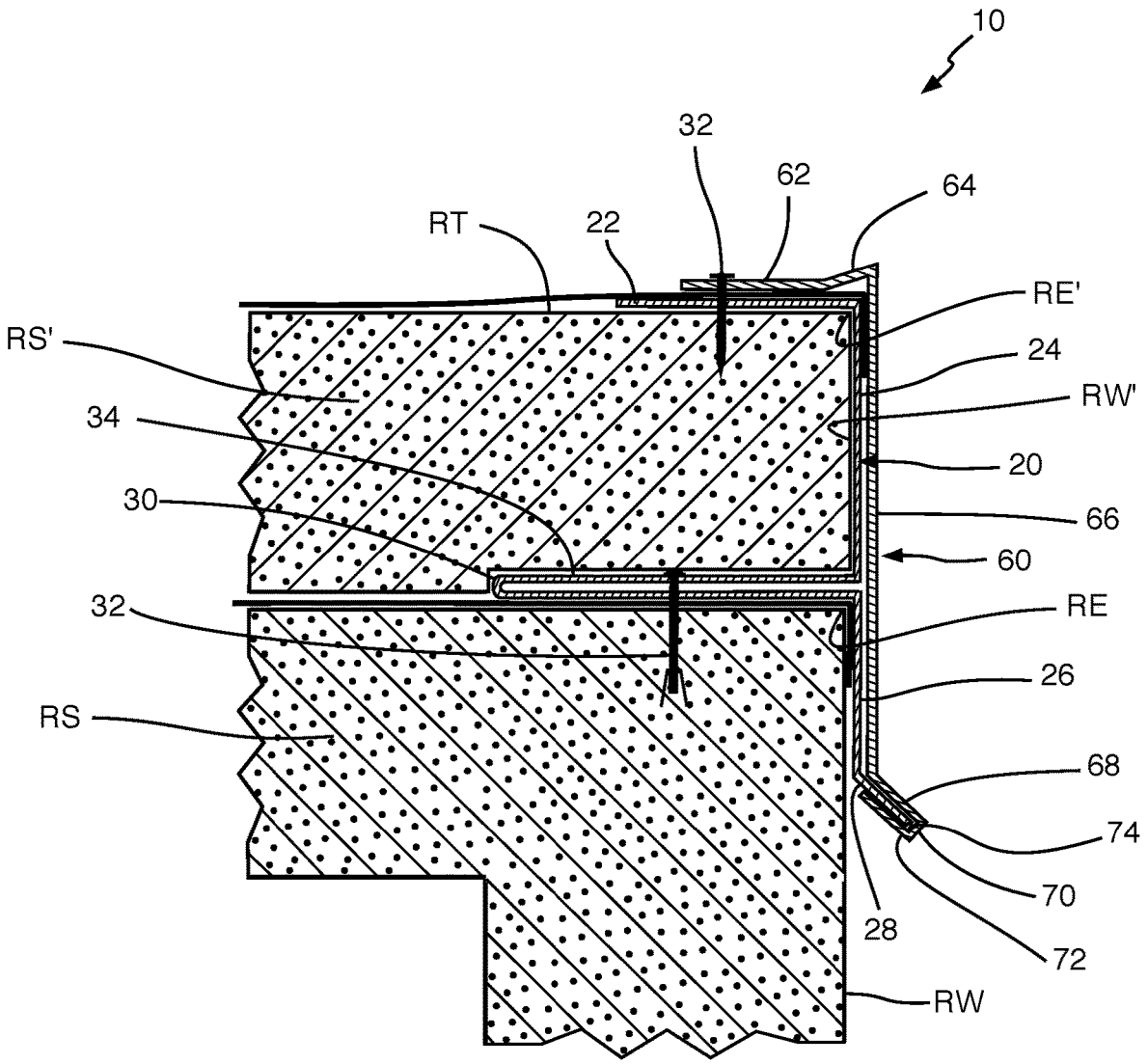
FIG. 5 is a third cross-sectioned side view of the present invention illustrating the blocking assembly secured onto the roof edge and the cover assembly mounted onto the blocking assembly.

As seen in FIGS. 4 and 5, cover assembly 60 is then mounted onto blocking assembly 20, whereby channel 74 receives locking tab 28. Side flange 66 is then biased towards lateral flanges 24 and 26, while cover top flange 62 mounts onto top flange 22.

As seen in FIG. 5, once mounted thereon, cover assembly 60 is secured to blocking assembly 20 at top flange 22, and to roof top wall RT, with fastening means 32. Fastening means 32 include, but are not limited to nails, screws, bolts, rivets, adhesives, and other similar fastening means.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A roof edge blocking with cleat comprising:

A) a blocking assembly having a top flange, a first lateral flange, a second lateral flange, an anchoring flange, and a locking tab, an upper wall and a lower wall of said anchoring flange extending from said first and second lateral flanges respectively, and are substantially parallel to said top flange; and B) a cover assembly having a cover top flange, an angular wall, a side flange, and a channel, whereby said cover assembly mounts onto said blocking assembly.

2. The roof edge blocking with cleat set forth in claim 1, further characterized in that said first lateral flange extends from said top flange.

3. The roof edge blocking with cleat set forth in claim 1, further characterized in that said upper wall and said lower wall are joined at said anchoring flange to define an elongated aperture.

4. The roof edge blocking with cleat set forth in claim 1, further characterized in that said locking tab extends outwardly from said second lateral flange defining a first predetermined angle.

5. The roof edge blocking with cleat set forth in claim 1, further characterized in that said first lateral flange comprises a first predetermined height and said second lateral flange comprises a second predetermined height.

6. The roof edge blocking with cleat set forth in claim 5, further characterized in that said first predetermined height is taller than said second predetermined height.

7. The roof edge blocking with cleat set forth in claim 1, further characterized in that said first lateral flange and said second lateral flange relatively align in a plane.

8. The roof edge blocking with cleat set forth in claim 1, further characterized in that said top flange has a first predetermined width and said upper wall has a second predetermined width.

9. The roof edge blocking with cleat set forth in claim 8, further characterized in that said first predetermined width is narrower than said second predetermined width.

10. The roof edge blocking with cleat set forth in claim 1, further characterized in that said blocking assembly further comprises fastening means.

11. The roof edge blocking with cleat set forth in claim 1, further characterized in that said angular wall extends from said cover top flange to said side flange.

12. The roof edge blocking with cleat set forth in claim 4, further characterized in that said channel is defined by an exterior cleat strip, a base cleat strip, and an interior cleat strip.

13. The roof edge blocking with cleat set forth in claim 12, further characterized in that said base cleat strip is perpendicular to said exterior cleat strip and to said interior cleat strip.

14. The roof edge blocking with cleat set forth in claim 12, further characterized in that said exterior cleat strip extends outwardly from said side flange defining a second predetermined angle.

15. The roof edge blocking with cleat set forth in claim 14, further characterized in that said first predetermined angle defined by said locking tab, and said second predetermined angle defined by said exterior cleat strip, are approximately the same.

16. The roof edge blocking with cleat set forth in claim 12, further characterized in that said interior cleat strip is relatively parallel to said exterior cleat strip, whereby said locking tab is received within said channel defined between said exterior cleat strip and said interior cleat strip.

17. The roof edge blocking with cleat set forth in claim 1, wherein said blocking assembly is adapted to first be mounted onto a first roof structure having a first roof edge, whereby said anchoring flange is fixed onto said first roof structure with first fastening means.

18. The roof edge blocking with cleat set forth in claim 17, wherein a second roof structure having a second roof edge is adapted to then be inserted and mounted onto said upper wall so that said top flange mounts onto a roof top wall, while said first lateral flange and said second lateral flange bias towards an exterior side of a first roof wall and an exterior side of a second roof wall respectively.

19. The roof edge blocking with cleat set forth in claim 18, wherein said cover assembly is adapted to then be mounted onto said blocking assembly, whereby said channel receives said locking tab, and said side flange is then biased towards said first and second lateral flanges, while said cover top flange mounts onto said top flange and once mounted thereon, said cover assembly is secured to said blocking assembly at said top flange, and to a roof top wall, with second fastening means.

* * * * *